US006224259B1

(12) United States Patent
Guerra

(10) Patent No.: US 6,224,259 B1
(45) Date of Patent: May 1, 2001

(54) LAUNDRY BAG

(76) Inventor: Luis Guerra, 68-09 Burns St. Apt. E2, Forest Hills, NY (US) 11375

( * ) Notice: Subject to any disclaimer, the term of this patent is extended or adjusted under 35 U.S.C. 154(b) by 0 days.

(21) Appl. No.: 09/502,929

(22) Filed: Feb. 11, 2000

(51) Int. Cl.[7] ..... B65D 33/14

(52) U.S. Cl. ..... 383/24; 383/2; 383/16; 383/33; 383/72; 383/74; 383/117

(58) Field of Search ..... 383/16, 24, 33, 383/72, 74, 76, 117, 2, 38, 40

(56) References Cited

U.S. PATENT DOCUMENTS

| | | | | |
|---|---|---|---|---|
| 1,983,452 | * | 12/1934 | Gwaltney | 383/117 X |
| 2,015,119 | * | 9/1935 | McEwen | 383/117 X |
| 2,510,186 | * | 6/1950 | Marisco et al. | 383/72 X |
| 2,543,299 | * | 2/1951 | Pritchard | 383/16 X |
| 2,552,443 | * | 5/1951 | Molinari | 383/72 X |
| 2,761,480 | * | 9/1956 | Tames | 383/16 |
| 3,483,907 | * | 12/1969 | Corridon | 383/117 X |
| 4,694,503 | * | 9/1987 | Hydorn | 383/24 X |
| 4,974,967 | | 12/1990 | Tsuyoshi et al. . | |
| 4,979,833 | * | 12/1990 | Cook | 383/33 X |
| 5,000,582 | * | 3/1991 | Pierson | 383/117 X |
| 5,100,005 | * | 3/1992 | Noble et al. | 383/117 X |
| 5,238,305 | * | 8/1993 | Feller | 383/117 X |
| 5,746,514 | | 5/1998 | Orensten . | |

* cited by examiner

*Primary Examiner*—Jes F. Pascua
(74) *Attorney, Agent, or Firm*—Collard & Roe, P.C.

(57) ABSTRACT

A laundry bag is provided that is comprised of an open end and a closed end. Two loops are attached to the laundry bag. The first loop is located adjacent to the closed end, and the second loop is located adjacent to the open end. The laundry bag further comprises a drawstring which is moveably coupled to the open end and contains a fastener. To assure that the proper amount of clothing is placed inside the bag, the laundry bag hangs from a support structure, by the provided loops, in a folded manner. The open end of the bag is exposed for inserting clothing therein. Hanging the laundry bag in this folded position forms a front compartment that has an available laundry receiving volume of about 15% to 45%. Leaving an excess of laundry bag volume allows for clothing expansion during the drying cycle.

11 Claims, 4 Drawing Sheets

LAUNDRY BAG

BACKGROUND OF THE INVENTION

1. Field of the Invention

This invention relates to an improved laundry bag that can be used during washing and drying cycles. More specifically, the invention relates to a laundry bag that provides additional bag volume for expansion of wet clothing during the drying cycle.

2. The Prior Art

Generally, laundry bags have been used to store soiled or dirty clothing until it is time to do laundry. A laundry bag is helpful for carrying clothing to the machine. Once ready for washing, the user would remove the clothing from the bag and place the clothing into the washing machine and then the dryer. However, the loss of articles during washing created a need for a washable laundry bag. To alleviate this problem, there are laundry bags known in the prior art that store dirty laundry and can be washed therewith.

U.S. Pat. No. 5,746,514 to Orensten, discloses a spherical laundry bag that can be used during the washing cycle. This bag contains a closing means that allows the bag to maintain its spherical shape without interfering with the interior volume.

Additionally, U.S. Pat. No. 4,974,967 to Tsuyoshi et al., shows a laundry net in the form of an octahedron. This construction permits water to uniformly flow through the bag, irrespective of its position with respect to the flow of water.

The disadvantage of these laundry bags is that the clothing inside the bag is not properly cleaned or dried. Additionally, there is a lack of excess space within the bag for when clothing expands during the drying cycle. The mentioned references do not provide adequate additional space for this expansion, and therefore, clothing will be wrinkled due to the inadequate excess volume within the laundry bag.

SUMMARY OF THE INVENTION

Accordingly, it is an object of the present invention to provide a laundry bag with sufficient excess volume to allow for the expansion of laundry during the drying cycle.

It is another object of the present invention to provide a laundry bag that hangs in such a way as to permit only a designated portion of the bag to be filled with clothing.

It is a further object of the present invention to provide a laundry bag that maintains its open position while placing dirty clothing therein.

These and other objects are accomplished by a laundry bag comprising an open end and a closed end. The laundry bag is preferably egg shaped and made from a perforated mesh material. This mesh material is similar to that of the lining of men's swimming trunks. The material is durable and light weight. It also dries quickly and therefore, does not add any appreciable time to the drying cycle. The laundry bag is constructed with many pleats and gathers so that it readily expands when clothing is added.

Two loops are attached to the laundry bag. These loops are made of a material that can withstand the force from the loaded hanging laundry bag. The loops are preferably of a soft material to avoid damage to the laundry bag or machines during the washing and drying cycles. It is also preferred that the loops are made of a heavy cotton jean-like material. This material is useful during the drying cycle. Dryers gauge the length of drying time by using two methods: one is to measure the heat inside the machine and the other is to measure the humidity inside the machine. Since the laundry bag material dries very quickly, either type of machine method will prematurely gauge that the clothing is dry. The heavy cotton type material dries very slowly and will prevent the machine from sensing that the clothing is dry when only the bag is dry.

The first loop is located adjacent to the closed end and the second loop is located adjacent to the open end. The second loop is preferably attached to a drawstring which is located at the open end. The second loop is preferably 3½ to 4 inches in length and the second loop is preferably at least 2 inches longer than the first loop. These measurements allow for a hand to slip through the loops, and the loops act as handles for transporting the laundry bag.

The drawstring is moveably coupled to the open end and contains a fastener for closing the laundry bag. The bag is also provided with sections of stiff material, attached to the open end of the laundry bag at the second loop and at the drawstring fastener. These sections of stiff material maintain the laundry bag in an open position while inserting laundry. The section of stiff material at the second loop prevents this loop from moving when the drawstring is pulled to close the laundry bag. The bag is further provided with an inside pocket, to hold detergent or change, and is located at the open end.

To assure that the proper amount of clothing is placed inside the bag, the laundry bag hangs from a supporting structure, by the provided loops, in a folded manner. Folding the bag creates a front compartment that receives laundry through the open end. This front compartment has a laundry receiving volume of about 15% to 45% of the total bag volume, so that the washed clothing can expand into the remaining bag volume during the drying cycle.

In another embodiment of the invention, the laundry bag contains a demarcation which visually indicates where the 15% to 45% laundry bag capacity is located. This line can be made of a indelible ink or material attached to the laundry bag. It is preferred that the demarcation line is made of the same heavy cotton material as the loops. The laundry bag hangs from a supporting structure by the loop attached at the open end. Laundry is filled to the demarcation line, allowing for excess bag volume, so laundry washed in the laundry bag expands into remaining bag volume during drying cycle. Another embodiment consists of a similar laundry bag but without the demarcation line. The user of this laundry bag estimates where the proper filling point is located.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
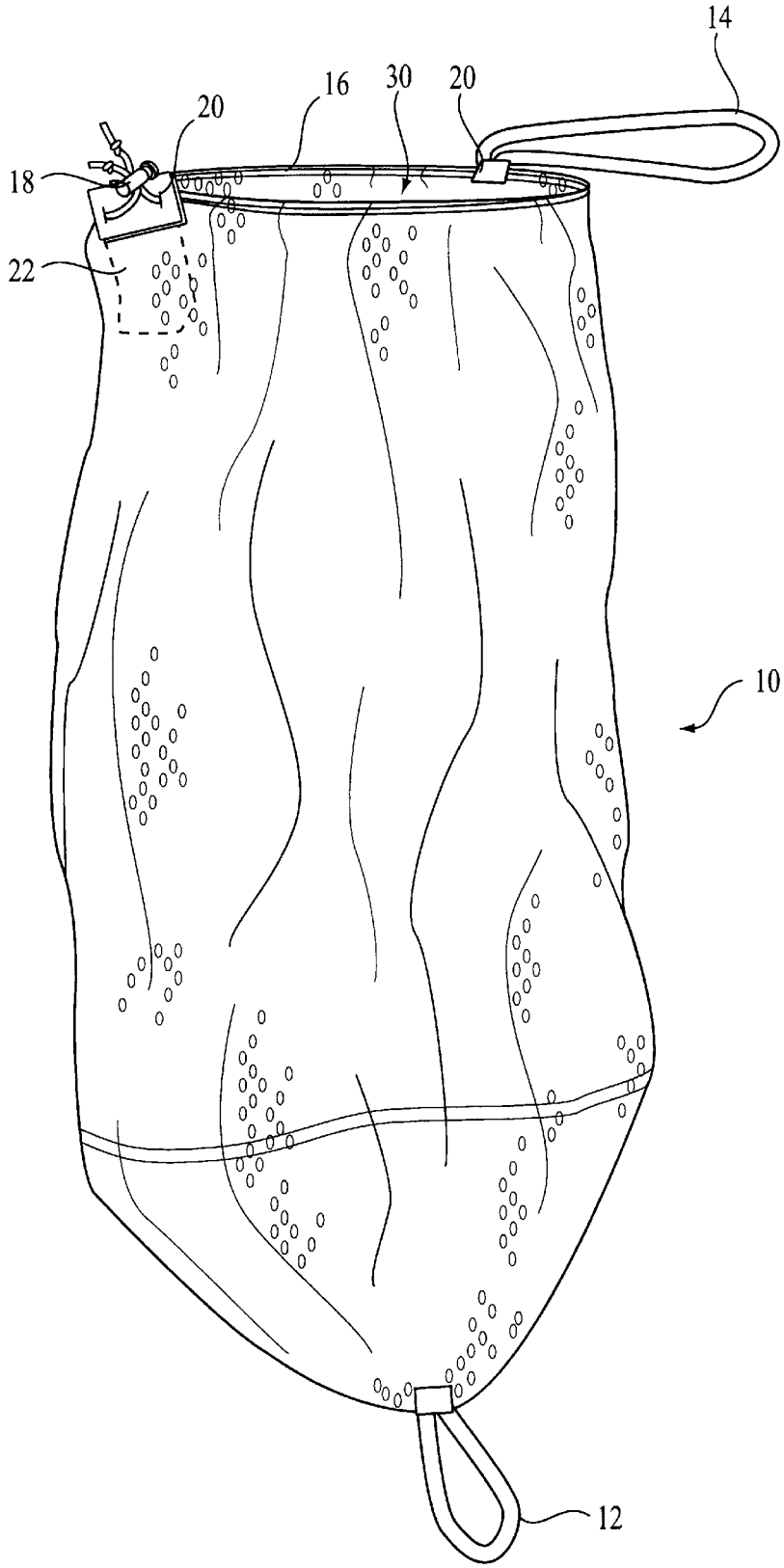
FIG. 1 shows the laundry bag, according to the present invention.

Referring now in detail to the drawings and, in particular FIG. 1 there is shown a laundry bag 10. The first loop 12 is located at the closed end, and second loop 14 is located at open end 30 and is attached to a drawstring 16. Drawstring 16 is moveably coupled to open end 30 and contains a fastener 18. Drawstring 16 is pulled through fastener 18 to close the open end of laundry bag 10 when transporting it to the laundry machine. Releasing the fastener and pulling the drawstring through the fastener pleats the open end until it closes. The fastener is replaced and maintains the laundry bag in its closed position during transport, washing and drying. First loop 12 and second loop 14 are used as handles to carry the laundry bag.

Sections of stiff material 20 are attached to the open end at second loop 14 and at fastener 18. The section of stiff material at second loop 14 prevents this loop from moving when the drawstring, to which the second loop is attached, is pulled for closing. Pocket 22 is located inside laundry bag 10, near the open end, and is used for carrying detergent or change.

Figure 2:
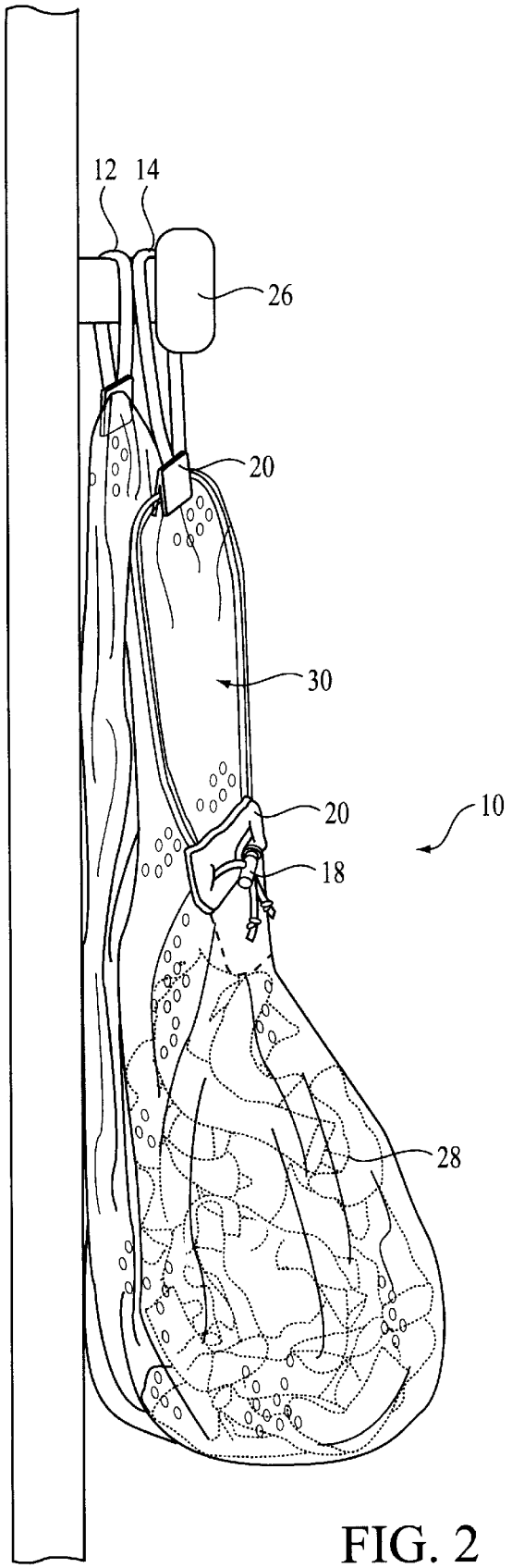
FIG. 2 shows a side view of the laundry bag containing clothing, in its hanging position.
Figure 3:
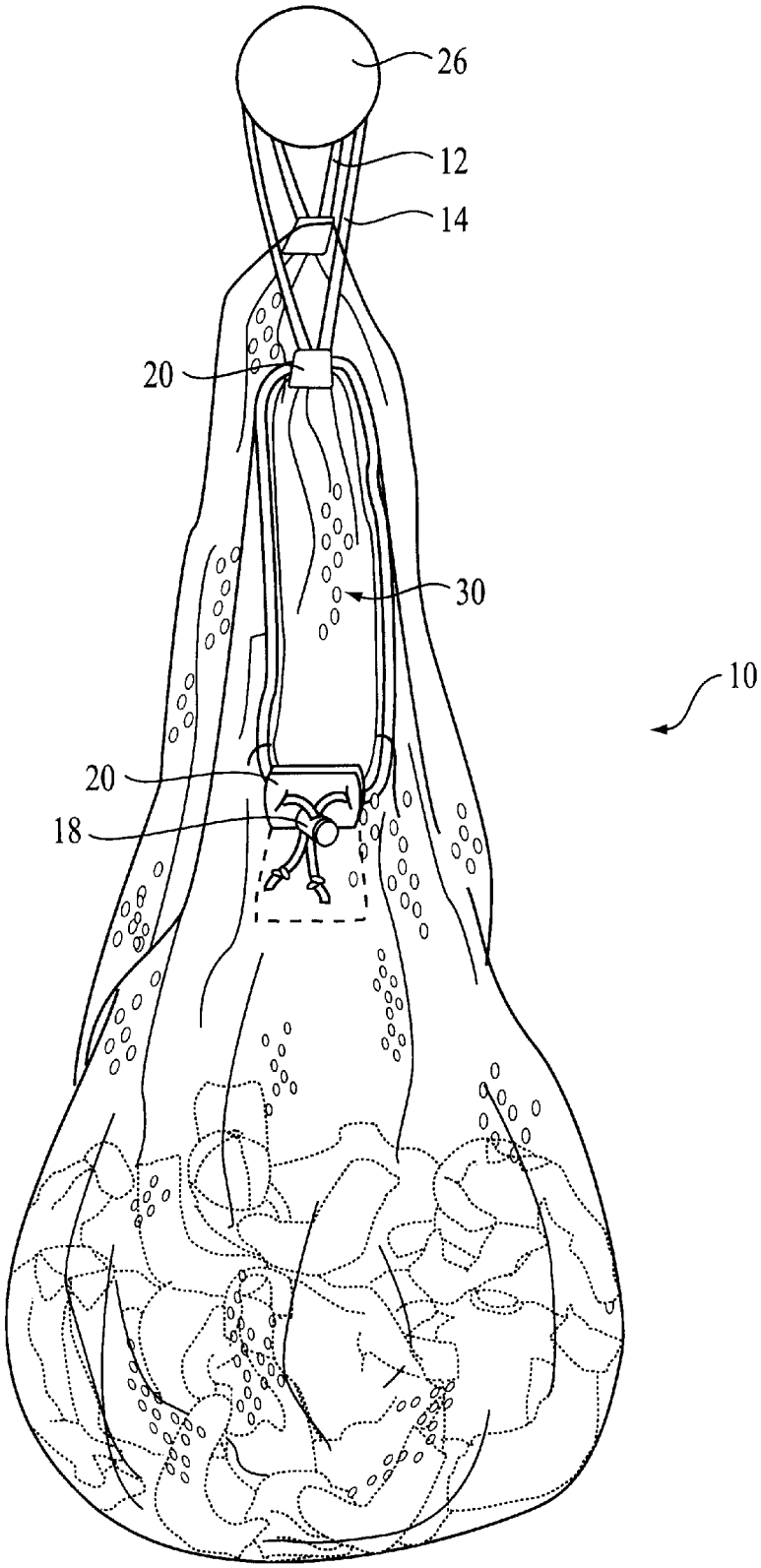
FIG. 3 shows a front view of the laundry bag in its hanging position.

FIGS. 2 and 3 show laundry bag 10 hanging from a supporting structure 26, such as a door knob. First loop 12 is initially placed onto supporting structure 26, and then second loop 14 is placed onto the supporting structure. Hanging the laundry bag in this folded position forms a front compartment that has an available laundry receiving volume of about 15% to 45%. Laundry is inserted through open end 30. The attachments of stiff sections 20 maintain the laundry bag in an open position while inserting laundry.

Figure 4:
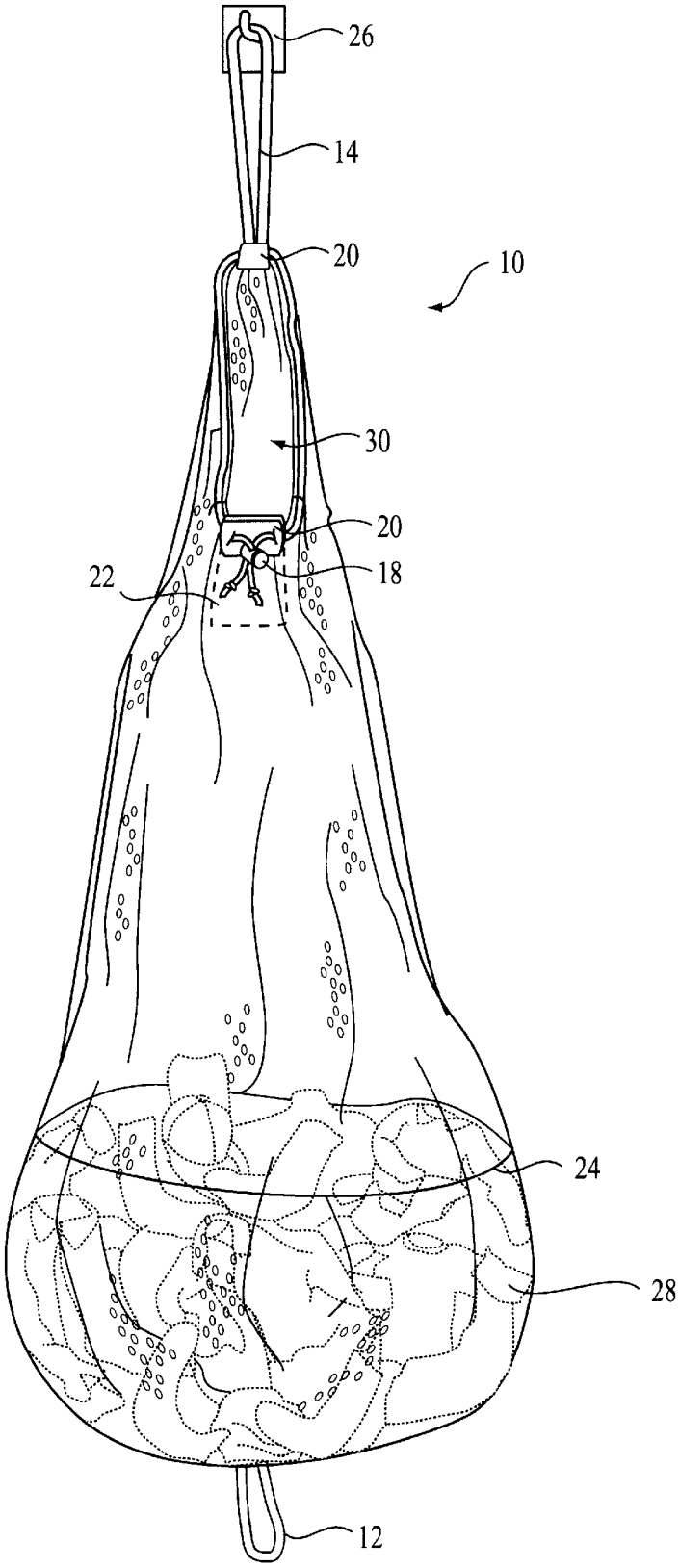
FIG. 4 shows another embodiment of the laundry bag according to the present invention.

FIG. 4 shows another embodiment of the invention. All the elements of the laundry bag are the same as in the first embodiment, except for the addition of a demarcation line 24. The demarcation line visually indicates where the 15% –45% laundry bag capacity is located. Therefore, in this embodiment laundry bag 10 hangs on supporting structure 26 by loop 14, and laundry 28 is filled to demarcation line 24. Filling laundry only to this demarcation line provides for adequate expansion space for the laundry during the drying cycle.

Accordingly, while only two embodiments of the present invention have been shown and described, it is obvious that many changes and modifications may be made thereunto without departing from the spirit and scope of the invention.

What is claimed is:

1. An egg-shaped water permeable laundry bag which stores laundry while hanging from a support structure in a folded manner, and contains laundry therein during washing and drying cycles comprising:

a) an open end for receiving laundry;

b) a closed end;

c) a first loop attached adjacent to said closed end;

d) a drawstring moveably coupled to said open end for closing the laundry bag;

e) a second loop attached adjacent to said open end said second loop being longer than said first loop, wherein the laundry bag hangs by said first loop and said second loop, in a folded manner, exposing said open end;

f) a first compartment for receiving laundry formed between said open end and the fold when the laundry bag is hanging in the folded manner; and g) a second compartment for allowing clothing to expand during drying cycles formed between said closed end and the fold when the laundry bag is hanging in the folded manner.

2. The laundry bag according to claim 1, wherein the laundry bag is made of a mesh material that is washable and dryable.

3. The laundry bag according to claim 1, wherein sections of stiff material are attached to said open end at said second loop and at said drawstring fastener, maintaining the laundry bag in an open position while inserting clothing.

4. The laundry bag according to claim 1, wherein said drawstring comprises a drawstring fastener.

5. The laundry bag according to claim 1, wherein said laundry bag contains a pocket inside the laundry bag adjacent to said open end.

6. An egg-shaped water permeable laundry bag which stores laundry while hanging from a support structure, and contains laundry therein during washing and drying cycles comprising:

a) an open end for receiving laundry;

b) a closed end;

c) a loop attached adjacent to said open end;

d) a drawstring moveably coupled to said open end; and e) a demarcation line to visually indicate a first compartment for receiving laundry and a second compartment into which clothing can expand during drying cycles, wherein said demarcation line is at a location at which the laundry bag volume is 15% –45%.

7. The laundry bag according to claim 6, wherein the laundry bag is made of a mesh material that is washable and dryable.

8. The laundry bag according to claims 6, wherein sections of stiff material are attached to said opened end at said loop and at said drawstring fastener, maintaining the laundry bag in an open position while inserting clothing.

9. The laundry bag according to claim 6, wherein a second loop is placed at said closed end for use as a handle when transporting the laundry bag.

10. The laundry bag according to claim 6, wherein said laundry bag contains a pocket located inside the laundry bag at said open end.

11. The laundry bag according to claim 6, wherein said drawstring comprises a drawstring fastener.

* * * * *